US006415584B1

(12) United States Patent
Whittall et al.

(10) Patent No.: US 6,415,584 B1
(45) Date of Patent: Jul. 9, 2002

(54) TUNING MEANS FOR TUNING STRINGED INSTRUMENTS, A GUITAR COMPRISING TUNING MEANS AND A METHOD OF TUNING STRINGED INSTRUMENTS

(75) Inventors: Richard John Whittall, Somerset; Nigel Alastair Dent, Oxford; Anthony Thomas Lambert, Wilts, all of (GB)

(73) Assignee: Automatic Tuning Developements Limited, Somerset (GB)

( * ) Notice: Subject to any disclaimer, the term of this patent is extended or adjusted under 35 U.S.C. 154(b) by 0 days.

(21) Appl. No.: 09/623,778

(22) PCT Filed: Mar. 10, 1999

(86) PCT No.: PCT/GB99/00712

§ 371 (c)(1),
(2), (4) Date: Nov. 13, 2000

(87) PCT Pub. No.: WO99/46757

PCT Pub. Date: Sep. 16, 1999

(30) Foreign Application Priority Data

Mar. 10, 1998 (GB) ..... 9804997

(51) Int. Cl.[7] ..... G10D 3/14
(52) U.S. Cl. ..... 54/312 R; 84/290; 84/454
(58) Field of Search ..... 84/312 R, 290, 84/454, 455, DIG. 18

(56) References Cited

U.S. PATENT DOCUMENTS

| | | | | |
|---|---|---|---|---|
| 4,026,182 A | | 5/1977 | Gilbrech | |
| 4,044,239 A | * | 8/1977 | Shimauchi et al. | 235/151 |
| 4,426,907 A | * | 1/1984 | Scholz | 84/454 |
| 4,584,923 A | * | 4/1986 | Minnick | 84/454 |
| 4,803,908 A | * | 2/1989 | Skinn et al. | 84/454 |
| 5,388,496 A | | 2/1995 | Miller et al. | |
| 5,477,765 A | | 12/1995 | Dietzman | |
| 5,886,270 A | | 3/1999 | Wynn | |
| 6,184,452 B1 | * | 2/2001 | Long et al. | 84/457 |

FOREIGN PATENT DOCUMENTS

| | | |
|---|---|---|
| GB | 2 202 075 A | 9/1988 |
| WO | WO 98/28732 | 7/1998 |

* cited by examiner

*Primary Examiner*—Robert E. Nappi
*Assistant Examiner*—Kim Lockett
(74) *Attorney, Agent, or Firm*—Marshall, Gerstein & Borun.

(57) ABSTRACT

A tuning means for a stringed instrument having one or more strings comprising detection means to provide a signal in response to vibration of the or each string and actuating means to vary the tension of the or each string under the control of an analysis means in response to said signal.

40 Claims, 4 Drawing Sheets

TUNING MEANS FOR TUNING STRINGED INSTRUMENTS, A GUITAR COMPRISING TUNING MEANS AND A METHOD OF TUNING STRINGED INSTRUMENTS

DESCRIPTION OF INVENTION

This invention relates to tuning means for tuning stringed instruments, a guitar comprising tuning means and a method of tuning stringed instruments, particularly but not exclusively relating to electric guitars.

The sound produced by a musical instrument may be considered to be made up of two elements, namely a pitch or note, and a quality which is characteristic of the type of instrument being played. Differences in quality are easily discernable to the human ear, for example the sound of a piano and a violin playing the same note. These differences in quality are due to the differences in the complex mixtures of harmonics which result from the construction of the instrument, whilst the fact that the human ear identifies two notes as the same despite being played on different instruments is due to the fundamental frequency (of which the harmonics are multiples) being the same.

Evolutionary improvements in design have resulted in instruments which, at least over a short period of time such as a practice session or concert, reliably produce the same pitch and quality of sound at the behest (and sometimes the skill) of the player. Due to changes in temperature or humidity however, or other physical change perhaps due merely to age or use, an instrument may not necessarily produce the same pitch over a longer period, say from day to day.

In western music notation, the audible range of frequencies is divided up into octaves, the frequency of any note being double that of an octave below it. An octave is divided into twelve notes separated in frequency by equal logarithmic steps, called semi-tones, and these twelve notes are divided into a group of seven natural notes, identified by the first seven letters of the alphabet, and a group of five notes, identified by their position relative to the other seven, either being the next higher semitone (sharp) or the next lower semitone (flat).

It is desirable that an instrument can be adjusted so that the note produced as a result of any given input from the player can be altered to a different setting, usually over a small range. Principal reasons for this are that the trained ear is accustomed to a given identified note actually producing a given frequency; or to ensure that different notes produced on the same instrument bear the correct relationship to one another; or to ensure that several instruments when played in concert produce exactly the same frequencies for the same notes. If this were not the case, an unpleasant sound would result, due to the production of beat frequencies. This process of adjusting the output pitch or frequency from the instrument is known as tuning.

Many instruments such as those of the brass or woodwind family are capable of playing only one note at a time from within the instrument's range, the relationship between the notes available being dictated essentially by the physical manufacture of the instrument, and the possibilities for tuning being limited to finely adjusting the entire range together. Other instruments notably those of the string family, and keyboard instruments, have several or even a multiplicity of individually tuned components. The tuning process for these instruments therefore involves bringing to the correct relative pitch each individual tuned component of the instrument. The pitch of the note produced by a string depends on its physical qualities of material and construction, its length, and its tension; and since in most cases the strings themselves, and the tuned lengths, are not changed in the tuning process, the only variable altered is the tension.

For reasons of weight, appearance, and the desire that the structure of the instrument itself contributes to the quality of the sound produced, commonly the structural stiffness of the instrument is such that the tension of the strings produces a detectable deflection in the structure. Consequently, adjustment of the tension of any one string alters the stresses on the instrument's structure, thereby altering its stressed shape, and thereby affecting the tuning of the other strings. In other words, tuning of any one string is not independent of the tuning of the others, and increasing the tension in one string to increase its pitch will result in the remaining strings having reduced tension, and vice versa. This is why an iterative tuning procedure is required, whereby the player tunes each string in turn, perhaps several times, even if the cause was that only a single string was out of tune.

Electric guitars fitted with a vibrato device are particularly affected by this phenomenon. In these instruments the tail end of the strings are anchored in a bridge plate which is free to pivot about its front edge. The tension of the strings tending to rotate the bridge plate in one direction is opposed by the tension in one or more springs located within the guitar body, and the bridge plate therefore assumes an equilibrium position where the resulting torques are balanced. Movement of the vibrato arm by the player thus moves the bridge plate away from the equilibrium position, generally reducing the tension in the strings and resulting in the characteristic sound effect. Upon release of the lever, the bridge plate resumes its equilibrium position and correct tuning is restored, depending on the absence of friction. It is obvious that any alteration in tension in any string alters the equilibrium position of the bridge plate, and therefore alters the pitch of the other strings.

It is an aim of the present invention provide a new or improved tuning means for a stringed instrument.

According to a first aspect of the invention we provide a tuning means for a stringed instrument having one or more strings comprising actuating means to vary the tension of the or each string.

The tuning means may comprise detection means to provide a signal in response to vibration of the or each string and analysis means to control said actuating means in response to said signal The actuating means may comprises a motor, which may be a DC motor.

The actuating means may comprise a gearbox.

The gearbox may be connected between said motor and a string.

The gearbox may be an epicyclic gearbox and may comprise six epicyclic stages.

The gearbox may have a reduction ratio in the range 2000:1 to 20000:1.

The analysis means may comprise a first filter means.

Said first filter means may comprise one or more filters.

Said first filter means may comprise a reconfigurable digital band pass filter.

The analysis means may comprise an analogue to digital converter to convert said signal to a digital signal before said signal is passed to said first filter.

The analysis means may further comprise a second filter means, said second filter means comprising an analogue band pass filter to filter the signal before said signal is passed to said first filter.

The analysis means may have at least one of an operating mode wherein the analysis means operates said actuating means in response to said signal, and an operating mode wherein the analysis means operates a visual display showing the tuning of each string in response to said signal. The operating modes may be selectable by an operator.

The visual display means may comprise a light emitting diode, which shows a first colour if the frequency of the string is above a desired frequency range, and a second colour if the frequency of the string is below a desired frequency range.

The tuning means may be operable to tune the or each string to a desired accuracy, preferably to within ±0.02 of a semitone.

Where the string instrument has a plurality of strings, said tuning means may be operable to perform a plurality of tuning cycles wherein each string is tuned in turn. Alternatively, the strings may be tuned simultaneously in each tuning cycle.

According to a second aspect of the invention we provide a guitar having a plurality of strings and comprising tuning means according to the first aspect of the invention.

The detection means may comprise a pick up provided on said guitar.

The pick up may comprise a coil responsive to all of the strings, or alternatively may comprise a plurality of coils each responsive to one of said strings.

Where the actuating means comprises a motor or a motor and a gearbox, the strings may be connected at one end to a bridge plate, said bridge plate being pivotally attached to the guitar and moveable to vary the tension of the strings, a mechanical block being provided attached to and pivotal with said bridge plate, said block housing said motor or said motor and said gearbox.

According to a third aspect of the invention, we provide a method of tuning a stringed instrument having one or more strings comprising operating an actuating means to vary the tension of the or each string.

The instrument may comprise a plurality of strings, each of said strings being initially tuned to within a preset frequency range, wherein the instrument comprises tuning means comprising a detection means to provide a signal in response to vibration of one or more of said stings, actuating means to adjust the tension of said strings operable by an analysis means in response to said signal, the method comprising the steps of causing all of the strings of the instrument to vibrate and performing a tuning cycle comprising measuring the frequency of vibration of one of said strings, operating said actuating means to adjust the tension of said one string to vary said frequency of said one string and repeating said process for each of said strings.

The method may comprise performing a plurality of said tuning cycles.

Each tuning cycle other than the first of said plurality of tuning cycles may comprise the further step of measuring the change in said frequency of said one string in response to operation of said actuating means in the preceding tuning cycle and varying the operation of said actuating means accordingly.

Where the analysis means comprises a reconfigurable filter, the method may further comprise the step of setting said reconfigurable filter to have a centre frequency corresponding to a desired frequency of one of said strings and a width corresponding to said frequency range.

Where one or more of said strings are initially outside said preset frequency range said method may comprise the prior steps of causing one of said one or more strings to vibrate, setting said filter to have a centre frequency and increasing said centre frequency to identify the frequency of said one string, and providing a visual indication of the tuning state of said string.

The tuning means may comprises a tuning means according to the first aspect of the invention.

The stringed instrument may comprise a guitar according to the second aspect of the invention.

The invention will now be described by way of example with reference to the accompanying drawings.

Figure 1:
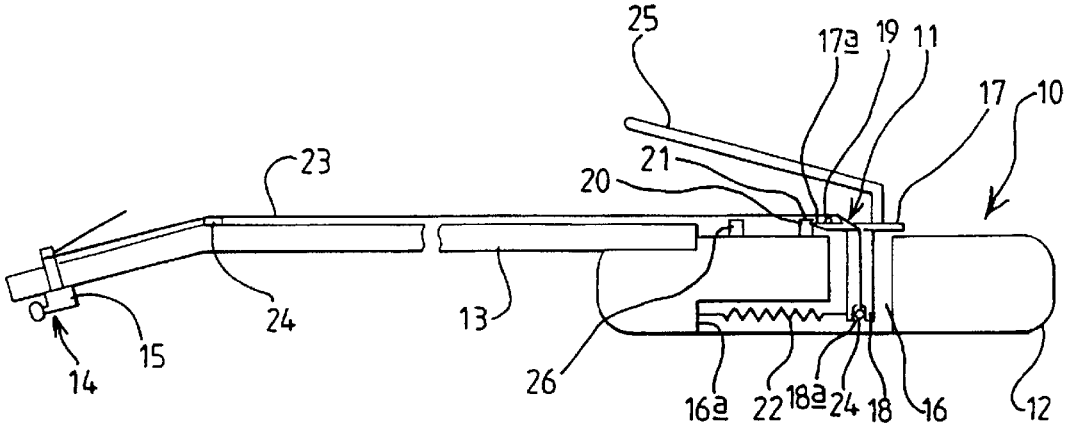
FIG. 1 is a diagrammatic cross-section through a conventional electric guitar.

FIG. 1 shows a part-sectional view of a typical solid-body six-string electric guitar indicated generally by 10 fitted with a vibrato bridge 11. The guitar 10 comprises a body 12 to which is rigidly attached a neck 13. A head 14 is rigidly attached to the end of the neck 13, wherein tuning pegs 15 are located.

The vibrato bridge 11 is located in an aperture 16 in the body 10, the vibrato bridge 11 comprising a bridge plate 17, on the underside of which is fastened a block 18, and on the top side a set of six saddles 19. The front edge 17*a* of the bridge plate 17 is received in grooves 20 provided on abutment 21, the abutment 21 usually comprising two grooved posts. A resiliently deformable element 22, for example one or more helical springs, is connected between a lower end of the block 18 and a wall 16*a* of the aperture 16, acting to urge the vibrato bridge 11 to rotate in a clockwise direction as shown in FIG. 1.

The guitar comprises a plurality of strings 23. Each string 23 is provided with an enlarged end 24 which is retained in a socket 18*a* on block 18. Each string 23 conventionally passes through a separate passage in the block 18 and bridge plate 17, over the appropriate saddle 19, down the neck 13, in an appropriate groove provided in a ridge hereinafter referred to as a "nut" 24 and thence to the appropriate tuning peg 15. The tuning peg 15 is generally provided with a worm-geared system to rotate the spindle as desired to tension the string 23, but at the same time by virtue of the worm gear be resistant to slackening due to back-driving by the string tension. The resonant length of the string 23 is thus the length between the nut 24 and the saddle 19, and the pitch of the note produced is dependent on the construction of the string 23, the tuned length, and the tension applied to the string 23 by winding the tuning peg. The combined tension of the strings tends to rotate the vibrato bridge 11 in an anticlockwise direction as seen in FIG. 1 which is resisted by the effect of the element 22. Thus the vibrato bridge 11 is in equilibrium between the torque applied by the strings 23 and that due to the element 22. A vibrato handle 25 attached to the vibrato bridge 11 may be moved by the operator to pivot the vibrato bridge about its front edge 11*a*.

Operation of the vibrato handle 25 thus alters the tension of the strings and produces a characteristic sound effect. One or more pick-ups 26 of conventional type are located on the guitar body to sense the vibration of the strings and provide an electrical signal accordingly.

According to one embodiment of the invention, the standard vibrato bridge 11 as described hereinbefore is replaced by a vibrato bridge 30 which will now be described with reference to FIG. 2. The same reference numeral are used for features corresponding to features shown in FIG. 1. A bridge plate 31 is provided, the front edge 31*a* of which, as before, is received on grooves 20 provided on an abutment 21, usually comprising a pair of grooved posts. A rotatable spindle 32 for each string is received in the bridge plate 31 and comprises a socket 32*a* to receive the enlarged string end 24, to permit the string to be anchored securely and wound around the spindle 32. Each spindle 32 is rotatable under the control of an electronic control means (not shown) by an actuating means comprising a DC motor 33 driving the spindle 32 via a multi-stage epicyclic gearbox 34. Rotation of the spindle 32 in one direction winds the string and therefore increases the tension and thus the pitch. Rotation of the spindle in the opposite direction lowers the tension and thus lowers the pitch. The direction of rotation of the spindle may easily be selected by driving the DC motor with a control signal of the appropriate polarity. The ratio of the gearbox has to be of a high order because a DC motor typically runs at very high rotation speed with very low output torque, whereas the spindle 32 which winds up the string 23 needs to rotate at very low speed for the purposes of accurate tuning control, and against relatively very large torque. No special spindle locking devices are required in order to maintain accurate tuning, because the inevitable small amounts of friction in a gearbox of such a high ratio prevent backdriving of the motor 33 by the string tension. A set of six such motors 33 and gearboxes 34, i.e. one motor and gearbox for each string, are mounted side by side in a block 35, attached to the bridge plate 31. The internal gearforms for the epicyclic gearboxes are formed in apertures in the block 35 in which the gearboxes 34 are received. The motors 33 are conveniently but not necessarily identical, despite the characteristics of the different strings 23, for example the necessary tension being considerably different in degree. Similarly, the gearboxes 34 are conveniently but not necessarily identical. The vibrato bridge 30 is mounted as normal in the aperture 16 provided in the guitar body 12, and is maintained in equilibrium position against the tension of the strings 23 by element 22. Normal operation of the vibrato is retained using handle 25, since the motors and gearboxes are entirely contained within the block vibrato bridge 33. Hence, no modification of the guitar body 12 is required to accommodate the vibrato bridge 30.

Figure 4:
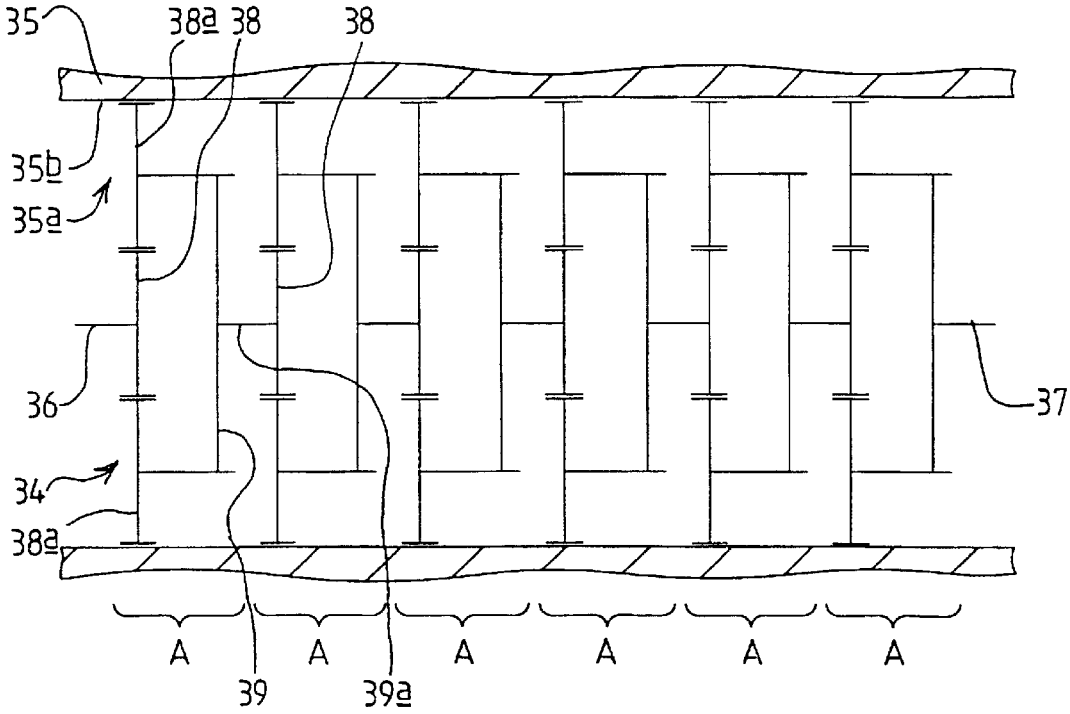
FIG. 4 is a diagrammatic plan view of an epicyclic gearbox according to an embodiment of the invention.

One of the epicyclic gearboxes 34 is shown in plan view in FIG. 4. The gearbox 34 is accommodated in an aperture 35*a* provided in the block 35, the block 35 here being shown in partial cutaway. The gearbox 34 comprises an input shaft 36 driven by the DC motor, and an output shaft 37 in driving connection with a spindle 32. As shown in FIG. 2, the motor 33, the gearbox 34, and the spindle 32 are oriented in line with one another. The epicyclic gearbox comprises six stages A. Each stage comprises a sun gear 38 in mesh with preferably three planet gears 38a. The planet gears 38*a* preferably engage with internal toothing provided on the surface 35*b* of the aperture 35*a*. The planet gears 38*a* are rotatably carried on a carrier 39, which is drivingly connected to the sun gear 37 of the succeeding epicyclic stage A by output shaft 39*a*. Each stage A of the gearbox provides a reduction in speed and an increase in torque. Different numbers of epicyclic stages A may be included as desired.

Figure 3:
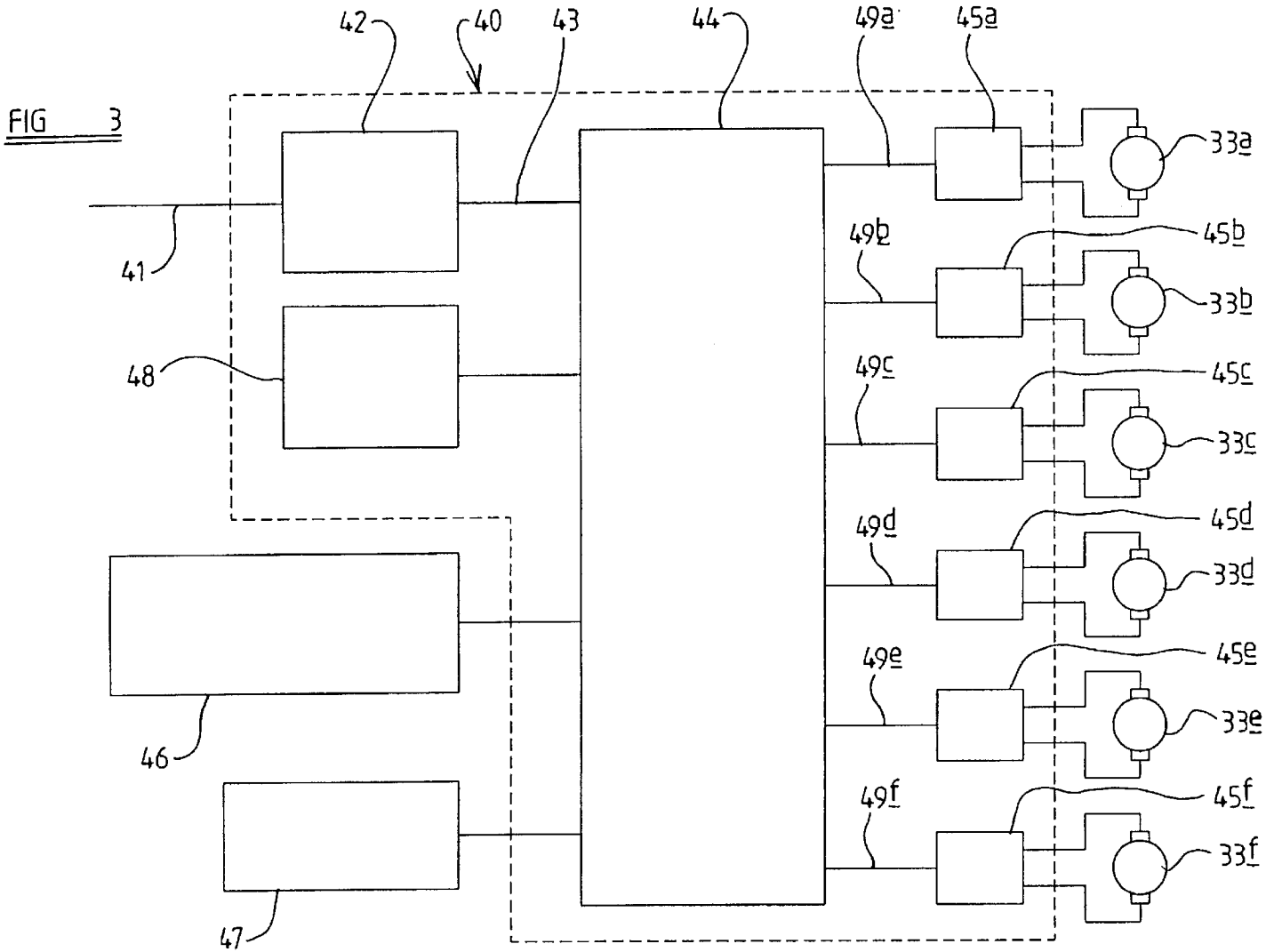
FIG. 3 is a schematic diagram of the analysis means and actuating means according to an embodiment of the invention.

The electronic control means of the tuning means is shown in schematic form, generally indicated at 40, in FIG. 3. Each pail of the electronic control means 40 comprises conventional electronic components and any arrangement of components may be used as desired to provide the desired function for each part.

Figure 2:
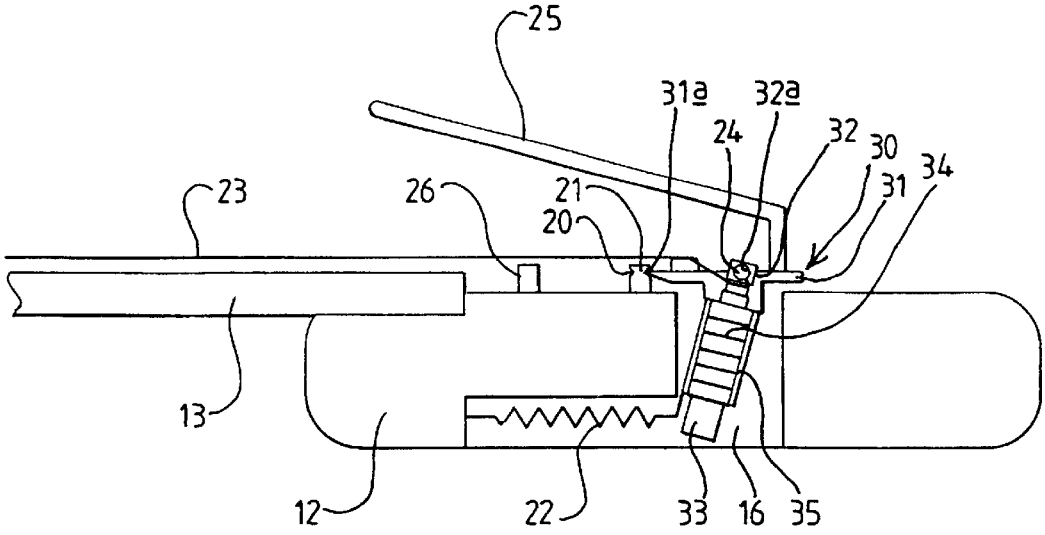
FIG. 2 is a diagrammatic partial cross-section to an enlarged scale through the electric guitar of FIG. 1, modified in accordance with an embodiment of the invention.

A signal from the pickup 26 shown in FIGS. 1 and 2 is provided on line 41 to a second filter means, comprising an analogue band pass filter 42. The analogue band pass filter 42 permits only that frequency bandwidth which contains the fundamental frequencies of all of the strings to pass, while excluding as many of the higher harmonic frequencies as possible. The analogue band pass filter 42 amplifies the filtered signal, which is then provided on line 43 to a digital signal processing (DSP) microcontroller 44. A motor 33*a*, 33*b*, 33*c*, 33*d*, 33*e*, 33*f* is provided for each string, each motor being operable in response to a corresponding motor controller 45*a*, 45*b*, 45*c*, 45*d*, 45*e*, 45*f* to vary the tension of the corresponding string. To provide a visual indication of the tuning state of each string, a display means is shown at 46, preferably comprising a plurality of light emitting diodes (LEDs) (not shown). Electric power is supplied to the electronic control means 40 by a battery 47. A mode switch 48 is provided to enable an operator to select the operating mode of the microcontroller 44.

The microcontroller 44 comprises an analogue-to-digital converter, converting the analogue signal from the analogue band pass filter 42 to a quantised digital signal. The analogue-to-digital conversion preferably provides an 8-bit signal, although other numbers of bits may be used if desired. The microcontroller 44 further comprises means to detect and measure the frequency components of the digitised signal which correspond to each string. The microcontroller then controls each of the motors 33*a*, 33*b*, 33*c*, 33*d*, 33*e*, 33*f* in response to the signal from the pickup 23 by sending a control signal on line 49*a*, 49*b*, 49*c*, 49*d*, 49*e*, 49*f* to the motor controller 45*a*, 45*b*, 45*c*, 45*d*, 45*e*, 45*f* corresponding to each motor.

The microcontroller 44 may be an 8-bit device, or a 16 bit device, or indeed may use any number of bits as desired. Alternatively, any suitable programmable device may be used.

The mode switch 48 may be moved to any one of three positions to select one of three modes. When the mode switch 48 is in a first position, selecting a first mode hereinafter referred to as the OFF mode, the guitar may be played without the tuning means operating. The guitar may also be tuned manually without any assistance from the tuning means. When a second mode is selected, hereinafter referred to as the TUNE mode, the operator strums all the strings and the microcontroller 44 operates to tune all of the strings to within for example ±0.02 semitones of the desired pitch. To enable the strings to be tuned such that TUNE mode can be successfully selected, a third mode, hereinafter referred to as the SET mode may be selected. in this mode, the operator tunes individual strings in conventional manner using the keys on the head of the guitar, and a visual indication is provided to show when the string has been tuned into the preset frequency range in which the TUNE mode made may be selected.

In the present example, the means provided in the microcontroller 44 to detect and measure the frequency components of the digitised signal preferably comprises a first filter means comprising a reconfigurable digital band pass filter.

The bandwidth of the analogue band pass filter 42 is preferably selected to exclude the sampling frequency of the digital band pass filter. In the present example, the sampling frequency of the digital band pass filter is set to 2 kHz when testing the low E, A, D and G strings, and 4 kHz when testing the B and high E strings. The digital band pass filter's centre frequency and width can be set, allowing the digital band pass filter to be set to have a centre frequency corresponding to the desired frequency of the string which is to be tuned and a width according to whether the SET mode or TUNE mode has been selected. Only a frequency contained in the signal which falls within the frequency width of the digital band pass filter will be passed by the digital band pass filter. The passed frequency will be in the form of a digitised sinusoidal waveform, and the frequency is measured by measuring the time between 'zero-crossings' of the waveform. Each zero-crossing time may be more accurately located by performing a linear interpolation between the signal values adjacent to the zero-crossing, and hence the time between zero-crossings can more accurately calculated. Other techniques for identifying and measuring the required frequencies, such as Fourier analysis, may be used if desired.

When SET mode has been selected, for example when the guitar has been restrung, the operator plucks only the string which he is currently tuning. The centre frequency of the digital band pass filter is scanned from a minimum frequency through increasing frequencies until a signal is passed by the digital band pass filter. By scanning the centre frequency in this manner, the fundamental frequency of the string is detected and any higher harmonics are avoided. The frequency of the passed signal is measured using the zero-crossing method identified above. The string which is being tuned is identified from the frequency range in which the passed signal falls and the frequency of the passed signal is compared to the required frequency for that string. A visual indication of the tuning state of the string is then provided by the LED panel 20, which comprises 6 LEDs, one corresponding to each string. The LEDs are preferably three-colour LEDs, such that a first colour, e.g. red, can be displayed when the frequency of the string is too high, a second colour, e.g. amber, is displayed when the frequency of the string is too low and a third colour, e.g. green, is displayed when the frequency is within the preset frequency range in which the microcontroller can tune the string in TUNE mode. The operator can hence manually tune the strings in response to the tuning information shown by the LEDs until all of the LEDs display the third colour, indicating that the TUNE mode can be selected to enable the tuning to be completed automatically. The desired frequency for each string and the parameters for the reconfigurable digital band pass filter may be held in a memory provided in the microcontroller 44. A number of different tuning modes may be held by the microcontroller 44 and be selectable by the operator. With suitable detection and analysis means, it is of course possible that a SET mode may be provided in which all the strings are strummed simultaneously.

Figure 5:
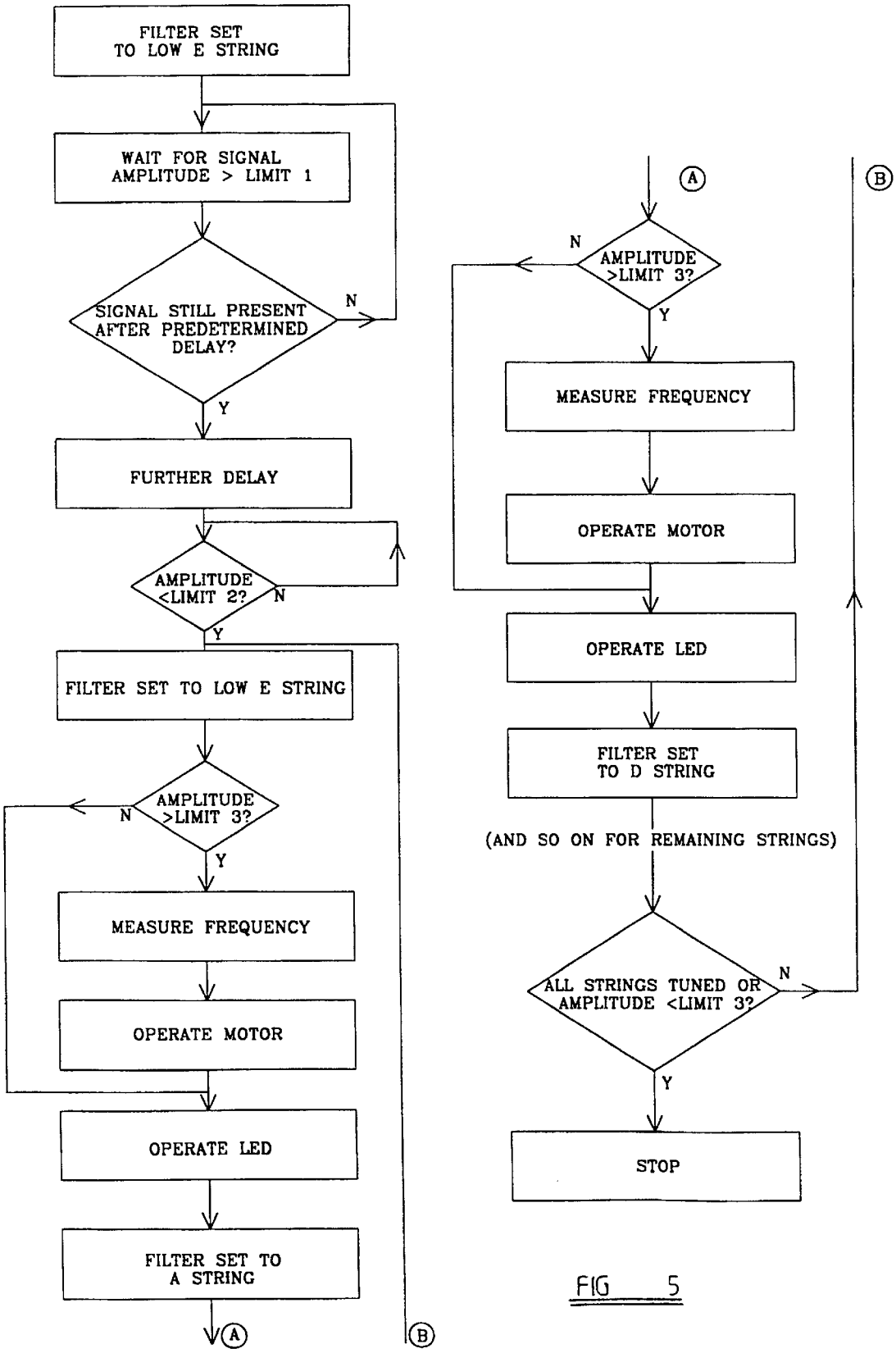
FIG. 5 is a diagrammatic representation of the function of an algorithm for tuning strings of a guitar.

When TUNE mode has been selected, the microcontroller 44 performs the steps of FIG. 5. The reconfigurable digital filter is set to the low E string and the system waits for a signal with an amplitude above a predetermined threshold, referred to as Limit 1. The operator strums all the strings of the guitar and a signal is passed from the pickup 26 to the microcontroller 44. Once a signal is detected, the microcontroller waits for a first set period before continuing, to eliminate any transient signals.

When a guitar string is strummed, it initially vibrates at a higher frequency than its fundamental frequency. The duration and the magnitude of the higher frequency is dependent on how hard the string is strummed. The strength of the strum can of course be calculated from the initial amplitude of the signal from that string. Once the first set period has elapsed since the initial signal from the low E string, a further time delay is hence allowed to elapse to permit the initial higher frequency vibration to die away and the string to 'settle' to its fundamental frequency. The further time delay may be fixed, for example two seconds, or it may be varied depending on the initial detected amplitude.

Once the further time delay has elapsed measurement of the frequency component for each string only begins once the amplitude of the signal from the low E string has fallen below a predetermined maximum threshold, referred to as Limit 2. Any string may be tested if desired, but it is preferred to test the amplitude of the signal from the low E string since the time taken for the initial higher frequency vibration to die away is longest for this string.

As a further check, the frequency of vibration of the low E string may be measured for variation to check whether the string has settled to its fundamental frequency.

Once the time delay has elapsed and/or the low E string has settled to its fundamental frequency, and the amplitude of the signal from the low E string has fallen below Limit 2, the tuning means performs a plurality of tuning cycles. In each tuning cycle, the centre frequency of the reconfigurable digital band pass filter is set to the desired frequency of all the strings in turn, beginning with the low E string. The amplitude of the signal passed by the reconfigurable digital band pass filter is measured. If the amplitude is below a predetermined minimum threshold value, referred to as Limit 3, the tuning means considers that there is no signal, performs no tuning of that string and moves on to the next string. The level of the predetermined minimum threshold value is set to exclude any spurious signal arising from instabilities in the digital band-pass filter.

The frequency of the signal passed by the reconfigurable digital band pass filter is then measured, and its distance from the desired frequency for that string calculated. A signal comprising a single pulse is sent to the appropriate motor controller to cause the motor for that string to turn to increase or decrease the tension as appropriate, the length of the pulse determining the time for which the motor operates and hence the magnitude of change in tension, while the polarity of the pulse determines the direction in which the motor rotates and hence whether the tension is increased or decreased. This process is then carried out for each of the rest of the strings. As varying the tension in one string alters the tension in the remaining strings, the tuning cycle is repeated as needed until all the strings have either been tuned or the signal is below Limit 3 It may be that tuning may stop after some of the strings have been correctly tuned and some have not been fully tuned due to the amplitude of the signal for that string falling below Limit 3, in which case the strings may be strummed again to tune the remaining strings Since all of the strings have been strummed, not only is the fundamental frequency of each string present in the signal from the pickup but also those higher harmonic frequencies which lie within the bandwidth of the analogue band pass filter 42. Some of the harmonic frequencies lie close to the fundamental frequencies of other strings, and the bandwidth of the digital band pass filter is selected in TUNE mode to be sufficiently narrow for each fundamental frequency to exclude any nearby harmonic frequencies, hence the requirement for the strings to be tuned into a preset frequency range using the SET mode. For the B and high E strings, the harmonic frequencies of lower strings lie too close to the fundamental frequencies and instead the first harmonics of the B and high E strings are measured. By varying the tension of the B and high E strings to bring the first harmonic to its correct value, the fundamental frequency of each string is also tuned to the desired frequency. When performing a tuning cycle, the sampling frequency is set to its appropriate depending which string is being tested.

Preferably, the bandwidth of the digital band pass filter is set to within ±6–8% of the centre frequency, i.e. within about a semitone.

Alternatively, it would be possible to use a plurality of filters, either of fixed or reconfigurable parameters, in place of the single reconfigurable digital band pass filter. The use of a single reconfigurable filter reduces the hardware demands and thus the cost of the tuning means.

During the first tuning cycle, the length of the pulse sent to the motor controller is selected according to a predetermined rule. On second and subsequent tuning cycles, the frequency change in the string caused by the pulse generated by the previous tuning cycle is measured, and the frequency change for that string generated by a given pulse length calculated. The length of the pulse generated in the subsequent tuning cycle can then be varied using this calibration information. This learning process removes any need for an initial, separate calibration process prior to tuning. It also enables the electronic control means to tune strings of slightly different characteristics, for example from different manufacturers, or where a string has deteriorated through age or use. If desired, other pulse methods may be used, for example where a number of pulses are directed to the motor controller and the distance the motor moves depends on the width of the pulses (pulse-width modulation) or the number of the pulses.

Each tuning cycle in the present example is about 1.2 to 1.5 seconds. Ideally, no more than three tuning cycles should be needed to tune the strings. A single strum of the guitar strings lasts for at least approximately 5 seconds which is sufficient to permit at least two or three tuning cycles to be performed. The time taken to tune each string in each cycle is inversely dependent on the frequency of the string, and hence it would be possible to speed up the tuning cycle by measuring the first harmonics rather than the fundamentals of some or all of the strings, in addition to the B and high E strings.

The three-colour LEDs may be operated in TUNE mode to show the status of the strings. For example, an untuned string may be shown by a red LED, a tuned string by a green LED and a string where amplitude of the signal has fallen below Limit 3 by an amber LED.

The low E string is the first string to be tuned during a tuning cycle because variations in the tension of the low E string have the greatest effect on the tension of the other strings. The strings are successively tuned depending on their effect on the other strings, with the high E string being tuned last.

Where operating a motor produces no change in a string's frequency, the micro-controller can identify the likely cause. The microcontroller may monitor the current drawn by each motor. If the motor draws no current, it may be that the motor is not connected, or if the frequency of another string varies, that the motor has been wrongly connected. If the motor draws a normal current and the frequency of another string changes, it indicates that the string in the frequency range being measured has been wrongly tuned. If the motor draws an abnormally high current, this may indicate that the motor has mechanically seized. An appropriate visual indication may be provided drawing the operator's attention to the source of the error.

It will be clear that the electronics may be suitably adapted to accommodated, for example, a plurality of pickup coils each corresponding to one or more strings such as a hex pick up with one coil corresponding to each string. In this case, the filter means could be omitted since each string would generate a separate signal and there would be no need to select frequencies from a signal string form a composite signal. The physical size of the electronics is preferably such that it can be received within the body of the guitar beneath the pick guard, and as with the vibrato bridge 30 requires no physical alteration to the guitar itself.

Although the present example has described tuning a guitar to the E string, it will be apparent that the tuning means may tune the instrument to any desired tuning, whether of conventional type or not. The tuning means may be adapted to store a plurality of tunings and be operable to select a desired one of said plurality to which it is desired to tune the guitar. The tuning means may also be adapted to store a custom tuning as instructed by the operator and subsequently to tune the guitar to that tuning.

It will be apparent that the invention may be adapted as desired for use with any suitable stringed instrument.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. An instrument having one or more strings, each of said one or more strings having a tension and a corresponding frequency of vibration, in combination with a system for tuning said stringed instrument, the system for tuning the stringed instrument comprising:

an actuating means including a motor operable to vary the tension of each of said one or more strings, a detection means to provide a signal in response to a vibration of each of said one or more strings, and an analysis means to control said motor in response to said signal to vary the frequency of vibration of each of said one or more strings towards a desired frequency for each respective string, and wherein the stringed instrument includes a vibrato bridge movable to vary the tension of each of said one or more strings wherein each of said one or more strings is connected at one end to the actuating means and wherein the actuating means is carried by the vibrato bridge.

2. A combination according to claim 1, wherein the actuating means further comprises a gearbox connected between said motor and each of said one or more strings.

3. A combination according to claim 2 wherein the gearbox is an epicyclic gearbox.

4. A combination according to claim 3 wherein the epicyclic gearbox comprises six epicyclic stages.

5. A combination according to claim 2 wherein the gearbox has a reduction ratio in a range of 2000:1 to 20000:1.

6. A combination according to claim 3 wherein the motor comprises a DC motor.

7. A combination according to claim 1 wherein the vibrato bridge comprises a bridge plate and a saddle for a string, and wherein said actuating means is carried by the bridge plate.

8. A combination according to claim 7 wherein said motor is attached to the bridge plate.

9. A combination according to claim 8 wherein the actuating means further comprises a gearbox connected between the motor and the string and wherein said gearbox is attached to the bridge plate.

10. An instrument comprising one or more strings, in combination with a system for tuning said stringed instrument, each of said one or more strings having a tension and a corresponding frequency of vibration, the tuning system comprising:

an actuating means operable to vary the tension of each of said one or more strings, a detection means to provide a signal in response to a vibration of each of said one or more strings and an analysis means to control said actuating means in response to said signal to vary the frequency of vibration of each of said one or more strings towards a desired frequency for each respective string, wherein the actuating means comprises a motor, a gearbox and a spindle for connection to at least one of said one or more strings, the motor, the gearbox and the spindle being in line.

11. A combination according to claim 10 wherein the gearbox is an epicyclic gearbox.

12. A combination according to claim 11 wherein the epicyclic gearbox comprises six epicyclic stages.

13. A combination according to claim 10 wherein the gearbox has a reduction ratio in a range of 2000:1 to 20000:1.

14. A combination according to claim 10 wherein the motor comprises a DC motor.

15. A combination according to claim 10 wherein each of said one or more strings is connected at one end to a vibrato bridge, said vibrato bridge being pivotally attached to the stringed instrument and being movable to vary the tension of each of said one or more strings, and wherein the actuating means is carried by the vibrato bridge.

16. A combination according to claim 15 wherein the vibrato bridge comprises a bridge plate and a saddle for at least one of said one or more strings, and wherein said actuating means is carried by the bridge plate.

17. A combination according to claim 16 wherein said motor is attached to the bridge plate.

18. A combination according to claim 17 wherein said gearbox is attached to the bridge plate.

19. An instrument having a plurality of strings, in combination with a system for tuning said stringed instrument, said system including an analysis means, each string having a tension and a corresponding frequency of vibration, the analysis means being operable to receive a signal in response to vibration of all of said strings, the analysis means being further operable to perform a tuning cycle wherein the tuning cycle comprises the steps of setting a reconfigurable filter to select a signal corresponding to the frequency of vibration of a selected one of said strings, generating an output to be transmitted to the actuating means to vary the frequency of vibration of said selected string towards a desired frequency of vibration for that string, and repeating the steps for each other of said plurality of strings.

20. A combination according to claim 19 wherein said reconfigurable filter comprises a reconfigurable digital band pass filter.

21. A combination according to claim 19 wherein the analysis means comprises an analogue to digital converter to convert said signal to a digital signal before said signal is passed to said reconfigurable filter means.

22. A combination according to claim 19 wherein the analysis means comprises an analogue band pass filter to filter the signal before said signal is passed to said reconfigurable filter.

23. A combination according to claim 19 wherein the analysis means has at least one of an operating mode wherein the analysis means operates said actuating means in response to said signal, and an operating mode wherein the analysis means operates a visual display showing the tuning of each of said plurality of strings in response to said signal.

24. A combination according to claim 23 wherein the operating modes are selectable by an operator.

25. A combination according to claim 23 wherein the visual display means comprises a light emitting diode wherein the light emitting diode shows a first color if the frequency of the selected string is above a preset frequency range.

26. A combination according to claim 19 operable to tune each of said plurality of strings to within ±0.02 of a semitone.

27. A combination according to claim 19 wherein the strings are caused to vibrate by a single strum and the analysis means is operable to perform a plurality of tuning cycles in response to said strum.

28. A combination according to claim 19 operable to perform a plurality of said tuning cycles, wherein each tuning cycle other than the first of said plurality of tuning cycles comprises the further step of measuring the change in said frequency of said selected string in response to operation of said actuating means in the preceding tuning cycle and varying the operation of said actuating means in the present cycle accordingly.

29. A combination according to claim 19 wherein the step of setting said reconfigurable filter to select a string comprises setting the reconfigurable filter to have a center frequency corresponding to a desired frequency of the selected string.

30. A combination according to claim 19 wherein, prior to performing the tuning cycle the strings are within a preset frequency range.

31. A combination according to claim 30 wherein the step of setting said reconfigurable filter to select a string comprises setting the reconfigurable filter to have a center frequency corresponding to a desired frequency of the selected string, and wherein the reconfigurable filter is set to have a width corresponding to the preset frequency range.

32. A combination according to claim 30 wherein one or more of said strings are initially outside said preset frequency range, and each tuning cycle other than the first of said plurality of tuning cycles comprises the further steps of causing one of said one or more strings to vibrate, setting said filter to have a center frequency, and increasing said center frequency to identify the frequency of said one of said one or more strings, and providing a visual indication of a tuning state of said string.

33. A guitar having a plurality of strings in combination with a system for tuning said guitar, wherein each of said plurality of strings has a tension and a corresponding frequency of vibration, said system for tuning the guitar including an actuating means operable to vary the tension of each of said one or more strings, said actuating means including a motor operable to vary the tension of each of said plurality of strings, a detection means to provide a signal in response to vibration of each of said plurality of strings, and an analysis means to control said motor in response to said signal to vary the frequency of vibration of each string towards a desired frequency for that string, wherein the guitar includes a vibrato bridge movable to vary the tension of each string, wherein each string is connected at one end to the actuating means and wherein the actuating means is carried by the vibrato bridge.

34. A guitar in combination with a system for tuning said guitar according to claim 33 wherein said detection means comprises a pick up.

35. A guitar in combination with a system for tuning said guitar according to claim 34 wherein the pick up comprises a coil responsive to all of said strings.

36. A guitar having a plurality of strings in combination with a system for tuning said guitar, each string having a tension and a corresponding frequency of vibration, said system for tuning the guitar comprising an actuating means operable to vary the tension of the strings, a detection means to provide a signal in response to vibration of the strings and an analysis means to control said actuating means in response to said signal to vary the frequency of vibration of each string towards a desired frequency for each respective string, wherein the actuating means comprises a motor, a gearbox and a spindle for connection to a string, the motor, the gearbox, and the spindle being in line.

37. A guitar in combination with a system for tuning said guitar according to claim 36 wherein said detection means comprises a pick up.

38. A guitar in combination with a system for tuning said guitar according to claim 37 wherein the pick up comprises a coil responsive to all of said strings.

39. A guitar having a plurality of strings in combination with a system for tuning said guitar, said system having an analysis means, the analysis means being operable to receive a signal in response to vibration of all of said strings, the analysis means being operable to perform a tuning cycle wherein the tuning cycle comprises the steps of setting reconfigurable filter to select a signal corresponding to the frequency of vibration of a selected one of said strings, generating an output to be transmitted to the actuating means to vary the frequency of vibration of the selected string towards a desired frequency of vibration for that string, and repeating the steps for each of said other strings.

40. A method of tuning a stringed instrument having a plurality of strings, the method comprising the steps of receiving a signal in response to vibration of all of the strings and performing a tuning cycle, the tuning cycle comprising the steps of setting a reconfigurable filter to select a signal corresponding to a frequency of vibration of a selected one of said strings, generating an output to be transmitted to an actuating means to vary the frequency of vibration of the selected string towards a desired frequency of vibration for that string, and repeating the steps for each of said other strings.

* * * * *